United States Patent [19]

Naito et al.

[11] 4,202,710

[45] May 13, 1980

[54] CARBURIZATION OF FERROUS ALLOYS

[75] Inventors: Takeshi Naito, Hiratsuka; Yasutada Kibayashi, Machida, both of Japan

[73] Assignee: Kabushiki Kaisha Komatsu Seisakusho, Tokyo, Japan

[21] Appl. No.: 965,433

[22] Filed: Dec. 1, 1978

[51] Int. Cl.[2] ..... C21D 1/48

[52] U.S. Cl. ..... 148/16.5; 148/13.1

[58] Field of Search ..... 148/16.5, 13.1

[56] References Cited

U.S. PATENT DOCUMENTS

| | | | |
|---|---|---|---|
| 3,669,652 | 6/1972 | Young et al. | 148/16.5 |
| 4,038,109 | 7/1977 | Pflieger et al. | 148/16.5 |

FOREIGN PATENT DOCUMENTS

| | | |
|---|---|---|
| 610554 | 12/1960 | Canada . |
| 53-146233 | 12/1978 | Japan . |
| 53-146234 | 12/1978 | Japan . |

*Primary Examiner*—L. Dewayne Rutledge

*Assistant Examiner*—John P. Sheehan

*Attorney, Agent, or Firm*—Armstrong, Nikaido, Marmelstein & Kubovcik

[57] ABSTRACT

A method for carburizing low alloy steel having carbon content of no more than 0.5% employing two-step carburizing process. The method comprising pre-carburizing the steel in a carburizing atmosphere having a carbon potential of less than Acm to produce a carburized case having hypereutectoid composition, cooling the steel to transform the case into a bainite, pearlite or martensite structure, and carburizing the steel by heating thereof to a carburizing temperature for a sufficiently long time to produce carbides in a spheroidal or spherical form, the carburizing being carried out in such a manner that the heating speed of the steel is being controlled under 20° C. per minute in a region between $Ac_1$ temperature and 750° C.–950° C. and the carbon potential in the carburizing atmosphere is being maintained over Acm when the temperature is over $Ac_1$.

3 Claims, 10 Drawing Figures

(A : EUTECTOID C% OF SNCM21
B : Acm OF SNCM21 AT 930℃)

CARBURIZATION OF FERROUS ALLOYS

BACKGROUND OF THE INVENTION

This invention relates to a carburization of ferrous alloys, and more particularly, to a method of carburizing a low alloy steel having a carbon content of less than 0.5 percent to produce spheroidal or spherical carbides in a case of the steel.

Heretofore, it has been necessary to include more than 2.4% chromium in the alloy steel to produce spheroidal or spherical carbides by any of conventional carburizing processes.

It has been well known that spheroidal or spherical carbides may be randomly produced in austenite grain boundaries or within austenite grains by carburizing an alloy steel containing more than 2.4% chromium in a carburizing atmosphere having a carbon potential of more than Acm. However, for alloy steels containing less than 2% chromium widely used for practical application, carbides formation within austenite grains may hardly be occurred and net shape or massive carbides are produced in austenite grain boundaries even if the steels are subjected to a carburizing process in a carburizing atmosphere having a carbon potential of more than Acm.

A carburized steel having net shape or massive carbides in austenite grain boundaries are likely to produce quenching cracks and grinding cracks and have a poor pitting resistance or endurance limit of pitting. It is hardly possible to convert these net shape or massive carbides produced in grain boundaries into spheroidal or spherical carbides.

SUMMARY OF THE INVENTION

It is therefore an object of the present invention to provide an improved method for carburizing alloy steels.

Another object of the present invention is to provide a method for carburizing low alloy steels having a carbon content of less than 0.5% to produce spheroidal or spherical carbides within austenite grains or grain boundaries.

A further object of the present invention is to provide a method for carburizing low alloy steels wherein carburized products have excellent heat resistance, wear resistance and pitting resistance.

In accordance with an aspect of the present invention, low alloy steels having a carbon content no more than about 0.5% are carburized in a carburizing atmosphere having a carbon potential of less than Acm to produce a carburized case having hypereutectoid composition. This carburizing step is hereinafter called pre-carburizing.

The pre-carburized alloy steels are then cooled to transform the case into a bainite or pearlite structures or quenched to form martensite structure.

The alloy steels are reheated to a carburizing temperature for a sufficiently long time so as to be subjected to a carburization to produce carbides in a spheroidal or spherical form by employing carbides in the bainite or pearlite as nuclei or decomposing the martensite by heating to produce carbides particles and employing thereof as nuclei.

The carburizing is carried out in such a manner that the heating speed of said steel is being controlled under 20° C. per minute in a region from $Ac_1$ temperature to 750° C.–950° C. and the carbon potential in the carburizing atmosphere is being maintained over Acm when the temperature is over $Ac_1$.

The spheroidal or spherical carbides are present more than 30% by volume within a region between the case surface and 0.4 mm deep in the case carburized by the present invention and carburized alloy steels have excellent wear-resistance, heat-resistance and pitting resistance.

The above and other objects, features and advantages of the present invention will be readily apparent from the following description taken in conjunction with the accompanying drawings.

DETAILED DESCRIPTION OF THE INVENTION

Figure 1:
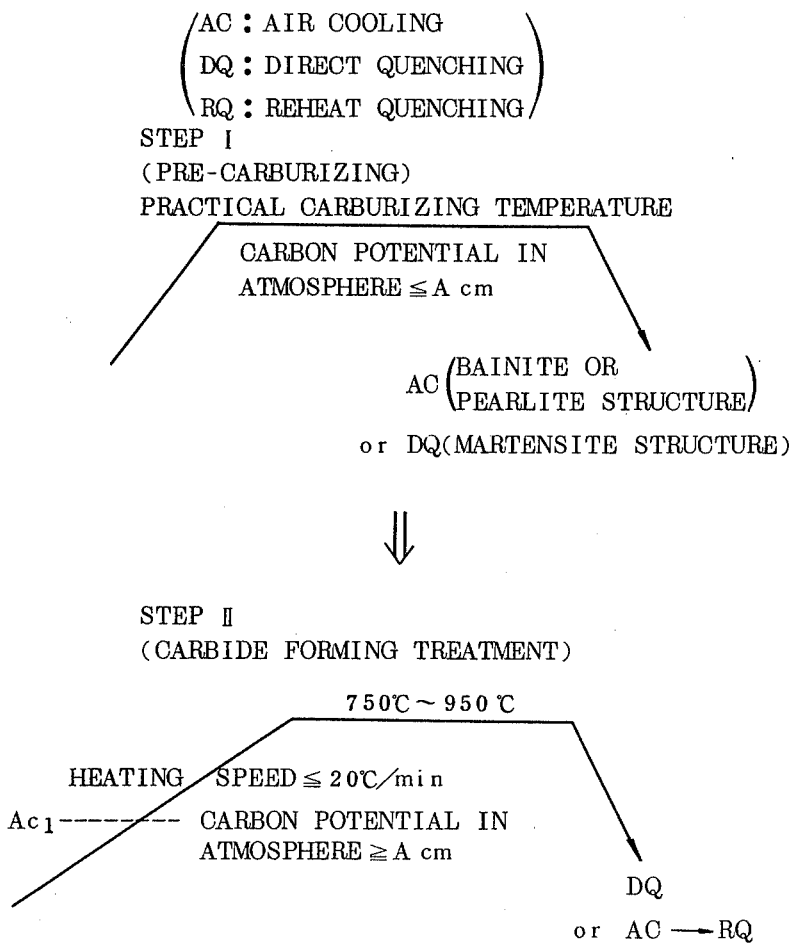
FIG. 1 is a schematic illustration of a carburizing process of the present invention.

The present invention will now be described in detail with reference to the accompanying drawings.

Alloy steels which are pertinent to the carburizing process of the present invention have following the compositions but are not limited thereto:

C: 0.05–0.50 w%
Si: 0.10–0.35
Mn: 0.30–2.00
Ni: less than 5.50
Cr: less than 2.00
Mo: less than 0.70
Balane Fe Case hardening steels, and machine structure carbon steels, machine structure low alloy steels are generally classified within the above composition.

As a first step, alloy steels are carburized by one of the conventional carburizing processes in a carburizing atmosphere having a carbon potential of less than Acm to produce a carburized case having hypereutectoid composition (hereinafter referred to pre-carburizing step). The pre-carburized steels are then cooled in the atmosphere to transform the carburized case into bainite or pearlite structure or quenched to form martensite structure.

"Acm" as used herein means saturated carbon content in austenite. Therefore, to state that the carbon potential is less than Acm would mean that the carbon potential is less than the saturated carbon content in austenite. "$Ac_1$" as utilized herein is defined as temperature at which austenite begins to be formed upon heating steel.

The steels are then reheated to a carburizing temperature for a sufficiently long time to produce carbides in a spheroidal or spherical form.

The carburizing of the steel is being carried out in such a manner that the heating speed of the steel is being controlled and maintained less than 20° C. per minute in a region from $Ac_1$ temperature to 750° C.–950° C. and the carbon potential in the carburizing atmosphere is being maintained over Acm when the temperature is over $Ac_1$. The mechanism of this second carburizing step is considered to be as follows. Carbides in the bainite or pearlite structure in the carburized case function as nuclei to produce spheroidal or spherical carbides within austenite grains and in austenite grain boundaries, or in the case of carburized alloys having martensite structure, the martensite structure is heated to an elevated temperature to precipitate carbide particles and as heating proceeds these carbide particles function as nuclei to produce spheroidal or spherical carbides.

Upon completion of this second carburizing, spherodial or spherical carbides are present more than 30% by volume within a region between 0.1 mm and 0.4 mm below the case surface.

The carburizing depth depends on composition of alloy steels and treatments for carburization. This second carburizing may be termed carbide forming treatment. After completion of the second carburizing step, the steels may be quenched directly from a temperature of 750° C.–950° C. or cooled in the atmosphere and reheated again to an elevated temperature avoiding decarburization before quenched in order to reduce retained austenite.

According to the method of the present invention, spheroidal or spherical carbides can be produced even if chromium content of the steels is less than 2.4%. The reason to this is hereinafter described.

It is well known that randomly distributed spheroidal or spherical carbides can be produced by carburizing steels having more than 2.4% chromium contained therein in a carburizing atmosphere having carbon potential of more than Acm. Chromium is well known as carbide stabilizer, an element likely to form carbide nuclei and in addition to this fact as chromium content increases in the steel, Acm line of the steel is likely to be moved toward low carbon side, thus reducing saturated carbon content in the austenite which contributes an easy formation of carbides. On the other hand, in the case of steels having less chromium content, even if the steels are carburized in an atmosphere having a carbon potential of more than Acm, carbides are hardly produced within austenite grains but produced in austenite grain boundaries in the form of net or massive shape.

According to the process of the present invention, however, which employs two-step carburization, randomly distributed spheroidal or spherical carbides can be produced. The reason to this is considered to be as follows. In the case of steels having eutectoid composition after the pre-carburizing, the carburized case has bainite or pearlite structure when cooled in the atmosphere. When the steel thus pre-carburized is reheated beyond $Ac_1$ temperature, the bainite or pearlite structure is transformed into austenite.

Since carbon content in the steel is less than eutectoid composition immediately after the above transformation, free carbides which are not dissolved in the austenite are present therein. These free carbides are likely to dissolve in the austenite as time passes and/or temperature increases.

However, since the carbon potential in the carburizing atmosphere is maintained above Acm, carbon tends to be introduced into the steel from the carburizing atmosphere to saturate the austenite therewith thus keeping the free carbides left undissolved into the austenite.

Since saturated carbon content of austenite increases as temperature is increased, all free carbides may be dissolved into the austenite when the heating speed above $Ac_1$ temperature is too fast because the free carbides are likely to dissolve into the unsaturated austenite faster than the austenite is saturated by the introduction of carbon from the carburizing atmosphere.

The upper limit of the heating speed was determined about 20° C. per minute by experiments. Therefore, spheroidal or spherical carbides can be produced by letting the above mentioned free carbides grow if the alloy steels are heated at a rate of less than 20° C. per minute in a region from $Ac_1$ temperature to a temperature which is high enough to produce carbides and maintained thereat for a sufficiently long time in a carburizing atmosphere haveing a carbon potential of more than Acm.

A martensite structure is produced when the pre-carburized steel is quenched.

Since spherical carbides can be produced by dissolving martensite on a way to reheat the quenched steel to an $Ac_1$ temperature, mainly spherical carbides can be produced in this case by employing spherical free carbides which are not dissolved into the austenite as nuclei.

In the case of steels having hypereutectoid composition after pre-carburizing, the amount of free carbides immediately after the austenite transformation is more than that of eutectoid composition.

Therefore, the amount of carbides produced after the second carburizing is greater than that of eutectoid composition.

Although fine net-shape carbides can be produced in the austenite grain boundaries when the steels having hypereutectoid composition after pre-carburizing is cooled in the atmosphere, these net-shape carbides are broken to produce spheroidal or spherical carbides after the steels are subjected to the second carburization or carbide forming treatment.

In the case of steels having hypoeutectoid compositions after pre-carburizing, since the amount of carbides produced after carbide forming treatment becomes less than 30% by volume, such characteristics as heat resistance, wear resistance or pitting resistance will not be improved so much compared with steels carburized by conventional carburizing methods.

Accordingly, it is necessary to make the steel composition eutectoid or hypereutectoid after pre-carburizing step.

Further, since net-shape or massive carbides are produced in the austenite grain boundaries when the carbon content in the case of the steel exceeds Acm, the carbon potential in the carburizing atmosphere for pre-carburizing must be maintained under Acm.

The lower temperature limit for the second carburizing step or carbides forming treatment is about 750° C.

which is immediately above $Ac_1$ temperature for low carbon and low alloy steels and upper limit is about 950° C. which is determined by durability limit of carburization furnace and an excessive grain groth in the core.

The upper limit of the carbon content in steels suitable for the carburizing method according to the present invention is about 0.5% by weight. This is because if the carbon content exceed 0.5%, carbide layer after carburization will become less than 0.05 mm. Therefore, heat resistance, wear resistance and pitting resistance will decrease remarkably. Accordingly, from a practical point of view, steels suitable for the present invention will be low and medium carbon low alloy steels.

Example I

JIS (Japanese Industrial Standard) SCM 21 (0.18C, 0.21Si, 0.63Mn, 0.011P, 0.016S, 0.07Ni, 0.94Cr and 0.18Mo) and JIS SNCM21 (0.23C, 0.29Si, 0.76Mn, 0.014P, 0.018S, 0.45Ni, 0.53Cr and 0.20Mo) were pre-carburized for 6 to 12 hours at a temperature of 930° C. to 980° C. in a propane RX gas having a $CO_2$ content of 0.06 to 0.25% (carbon potential of 0.50 to 1.48%) and then cooled in the atmosphere or quenched.

Then the workpieces were reheated to a carburizing temperature at a heating speed of 3° C./minute in the region from $Ac_1$ temperature to 900° C. by maintaining the carbon potential exceeding Acm (e.g. 1.0% $CO_2$ at 750° C., 0.61% $CO_2$ at 800° C. and 0.25% $CO_2$ at 850° C.) and carburized at 900° C. in an atmosphere having 0.12% $CO_2$ (carbon potential of 1.85%) for 6 hours and thereafter oil quenched.

Figure 2:
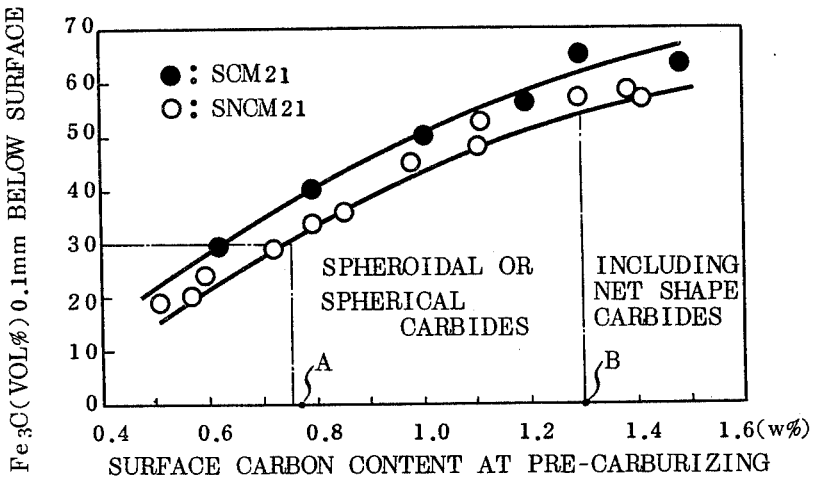
FIG. 2 is a graph showing an effect of surface carbon content after pre-carburizing on the produced $Fe_3C$ by volume % measured at 0.1 mm deep below surface of workpieces after subjecting them second carburizing step.

Carbides volume % at a depth of 0.1 mm from the case surface is plotted with respect to the surface carbon content at the pre-carburizing and shown in FIG. 2.

Eutectic carbon content for SCM21 and SNCM21 is about 0.78% and Acm carbon content at the pre-carburizing temperature (930° C.) is about 1.30%.

Little improvements will be observed over prior art carburizing methods on heat-resistance, wear-resistance and pitting-resistance when carbides volume content becomes less than 30%.

Therefore, it is reasonable to say that lower limit of the carbides volume content is about 30% in order to allow that present invention operate in practical sense. If the lower limit for the carbides volume content is set at 30%, the lower limit for surface carbon content at the pre-carburizing becomes around eutectic composition.

On the other hand, if the surface carbon content at the pre-carburizing exceeds Acm line of the steels to be carburized, net-shape or massive carbides can be produced in the austenite grain boundaries. Therefore, in order to produce spheroidal or spherical carbides within the austenite grains, the carbon potential of the carburizing atmosphere at the pre-carburizing be maintained more than that of eutectic composition and less than Acm.

Example II

SCM21 and SNCM21 steels having the same compositions as those of in Example I were pre-carburized at the temperature of 930° C.–980° C. for 6 to 12 hours in a carburizing atmosphere having $CO_2$ content of 0.18 to 0.06% (carbon potential of 0.80 to 1.30%). After having cooled in the atmosphere, the steels were reheated at variety of heating speeds of 0.12 to 30° C./minute from $Ac_1$ temperature to 900° C. maintaining the carbon potential of more than Acm and carburized at 900° C. for 6 hours in a carburizing atmosphere having $CO_2$ content of 0.12% (carbon potential of 1.85%).

Figure 3:
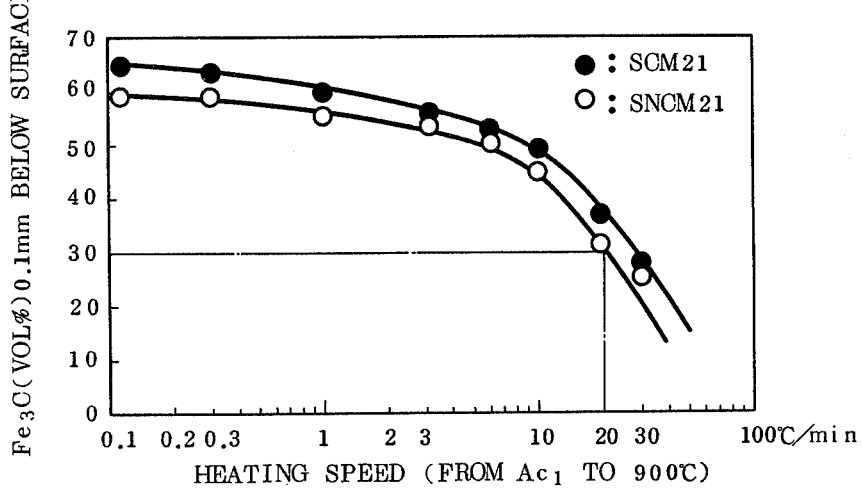
FIG. 3 is a graph showing a relationship between heating speed from $Ac_1$ temperature to 900° C. in the second carburizing step and the produced $Fe_3C$ by volume % measured at 0.1 mm deep below case surface.

The volume percentage of produced carbides at 0.1 mm below the case surface is plotted with respect to the heating speed from $Ac_1$ temperature to 900° C. and shown in FIG. 3. Since the lower limit for the carbides volume percent is set about 30% as mentioned hereinbefore, the upper limit for the heating speed is about 20° C./minute.

Example III

Alloy steels having different carbon contents (composition are shown in Table I) were pre-carburized at 930° C. for 10 hours in the RX gas having $CO_2$ content of 0.13% (carbon potential of 1.07%) and cooled in the atmosphere.

The steels were then reheated to elevated temperatures with heating speed of 3° C. per minute from $Ac_1$ temperature to 850° C.–930° C. in a RX gas atmosphere having carbon potential of more than Acm and carburized within the above temperature range for 6 hours in a RX gas atmosphere having $CO_2$ content of 0.25 to 0.06% (carbon potential of 1.63 to 2.10%). The carburized steels were then oil quenched. The thickness of the carbide layer is plotted with respect to the carbon content of the steels as shown in FIG. 4.

It is observed that the thickness of the carbide layer becomes less than 0.05 mm when the carbon content of the steels exceeds 0.5%. Therefore, in order to provide enough heat-resistance, wear-resistance and pitting-resistance, the upper limit of the carbon content in the steels will be set about 0.5%.

Figure 4:
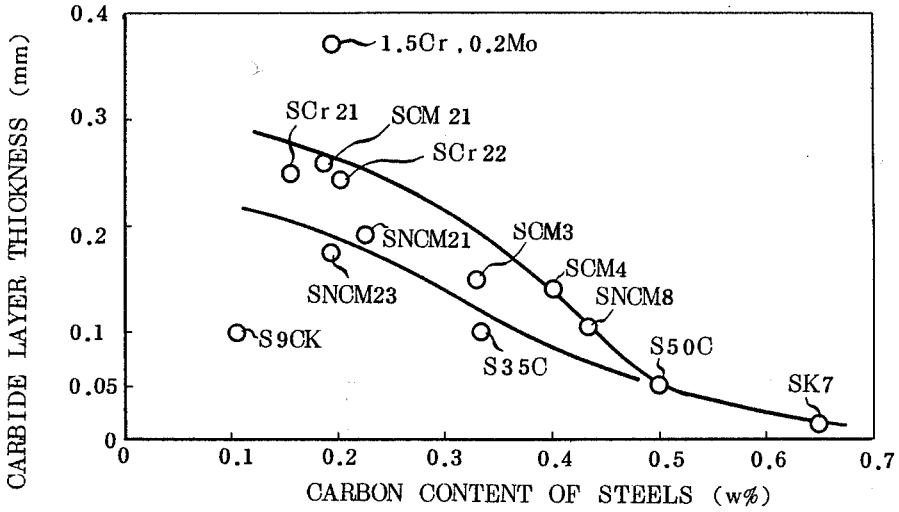
FIG. 4 is a graph showing an effect of carbon content of the workpieces on the thickness of the carbide case layer after the second carburizing step.

It can be seen from FIG. 4 that the higher the carbon content in the steels, the thinner the thickness of the carbide layer. The reason to this is considered to be as follows. Since the difference between the carbon potential in the carburizing atmosphere and the carbon content of the steels becomes smaller as the carbon content of the steels becomes higher, the carbon diffusing speed in the austenite becomes slower as the carbon content becomes higher.

Table I

| Composition (JIS)Steels | C | Si | Mn | P | S | Ni | Cr | Mo |
|---|---|---|---|---|---|---|---|---|
| S9CK | 0.11 | 0.25 | 0.52 | 0.015 | 0.018 | | | |
| S35C | 0.33 | 0.31 | 0.63 | 0.020 | 0.025 | | | |
| S50C | 0.50 | 0.26 | 0.70 | 0.021 | 0.019 | | | |
| SK7 | 0.65 | 0.20 | 0.45 | 0.020 | 0.017 | | | |
| SCr21 | 0.16 | 0.23 | 0.70 | 0.016 | 0.012 | 0.09 | 1.05 | |
| SCr22 | 0.21 | 0.28 | 0.75 | 0.022 | 0.010 | 0.09 | 1.12 | |
| SCM21 | 0.18 | 0.21 | 0.63 | 0.011 | 0.016 | 0.07 | 0.94 | 0.18 |
| SCM3 | 0.33 | 0.23 | 0.72 | 0.012 | 0.012 | 0.07 | 1.03 | 0.20 |
| SCM4 | 0.40 | 0.27 | 0.65 | 0.011 | 0.018 | 0.09 | 1.10 | 0.18 |
| SNCM21 | 0.23 | 0.29 | 0.76 | 0.014 | 0.018 | 0.45 | 0.53 | 0.20 |
| SNCM23 | 0.19 | 0.28 | 0.65 | 0.013 | 0.010 | 1.80 | 0.51 | 0.18 |
| SNCM8 | 0.43 | 0.28 | 0.75 | 0.014 | 0.018 | 1.65 | 0.75 | 0.17 |
| 1.5Cr,0.2Mo | 0.19 | 0.27 | 0.63 | 0.015 | 0.013 | 0.08 | 1.55 | 0.18 |

Example IV

Figure 5A:
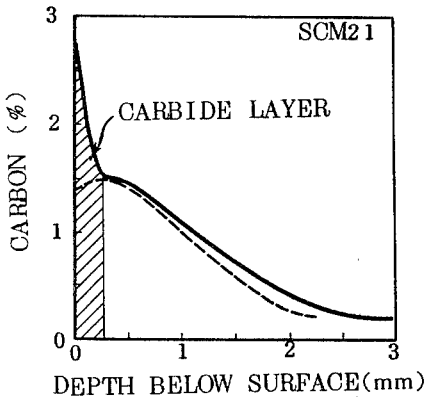
FIG. 5A to FIG. 5D are diagrams showing carbon content distributions for pre-carburized workpieces (dotted lines) and workpieces subjected to the second carburizing step (solid lines)
Figure 5B:
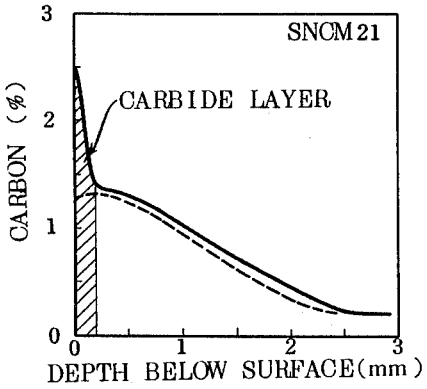
Figure 5C:
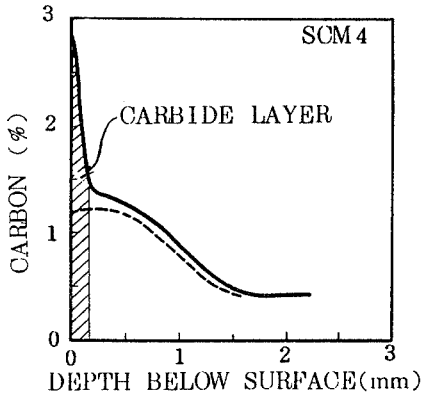
Figure 5D:
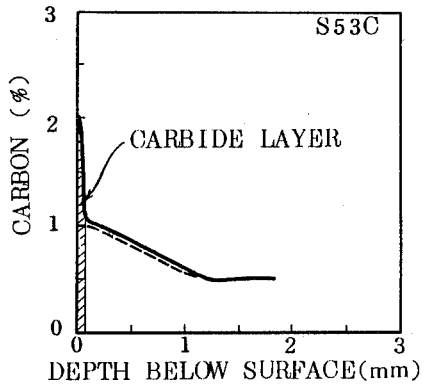

Four typical steels were picked up from Example III and the carbon content distribution after pre-carburizing and carbides forming treatment was plotted as illustrated in FIGS. 5A to 5B. As is clear from the drawing, the surface carbon content exceeds 2% in each case.

Dotted lines show the carbon contents after pre-carburizings and solid lines represent those of after carbides forming treatments. Areas covered by oblique lines show carbides produced.

Example V

SCM21(A) and SNCM21(B) were pre-carburized at a temperature of 930° C. for 12 hours in a carburizing atmosphere having $CO_2$ content of 0.13% and cooled in the atmosphere.

The steels were reheated to an elevated temperature with a heating speed of 3° C. per minute from $Ac_1$ temperature to 850° C. and carburized at 850° C. for 6 hours in a carburizing atmosphere having $CO_2$ content of 0.25% and then oil quenched. In another heat treatment, SCM21(C) and SNCM21(D) were carburized at a temperature of 930° C. for 16 hours in a carburizing atmosphere having $CO_2$ content of 0.18 and then air cooled.

Figure 6:
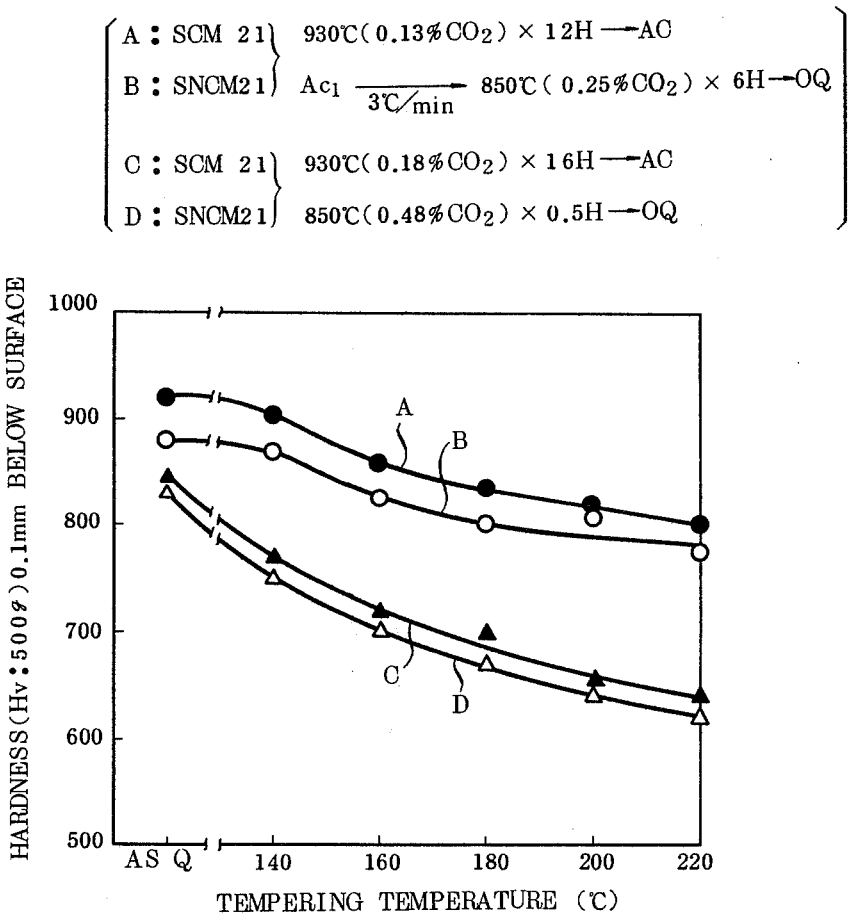
FIG. 6 is a graph showing a low temperature tempering characteristics in terms of hardness of carburized workpieces carburized by the method of the present invention and by a conventional method.

The steels were reheated to 850° C. for 30 minutes in an atmosphere having $CO_2$ content of 0.48% and then oil quenched. The hardness at 0.1 mm below surface were plotted with respect to tempering temperature as illustrated in FIG. 6. The steels identified by curves A and B were treated by the present invention while the steels identified by curves C and D were treated by a conventional method.

As is clear from the drawing, the steels treated by the present invention have greater temper softening resistances than those of steels treated by a conventional method.

Example VI

Figure 7:
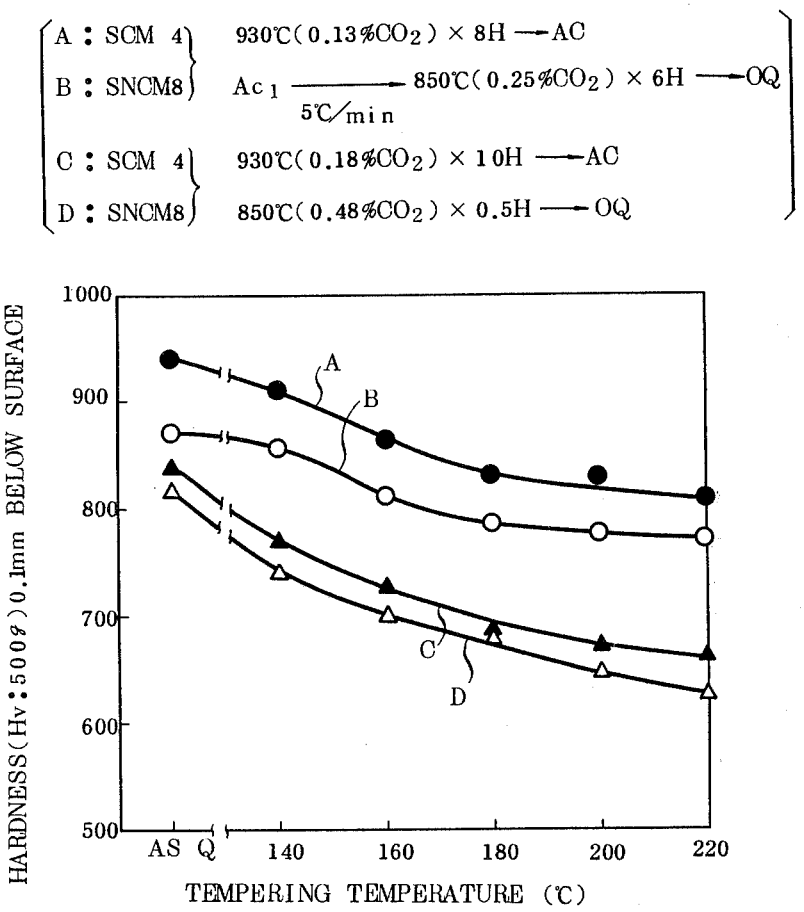
FIG. 7 is similar to FIG. 6 but employing other workpieces.

SCM4 and SNCM8 were subjected to by the same treatments as those of Example V and the hardness at 0.1 mm below surface were plotted with respect to tempering temperature as illustrated in FIG. 7. The steels identified by curves A and B were treated by the present invention while the steels identified by curves C and D were treated by a conventional method.

What we claim is:

1. A method for carburizing low alloy steels having carbon content of no more than about 0.5%, which method comprises the steps of:
   (a) pre-carburizing said steel in a carburizing atmosphere having a carbon potential of less than Acm to produce a carburized case having hypereutectoid composition;
   (b) cooling said steel to transform the case into a bainite, pearlite or martensite structure; and
   (c) carburizing said steel by heating thereof to a carburizing temperature for a sufficiently long time to produce carbides in a spheroidal or spherical form by employing carbides in the bainite or pearlite as nuclei or dissolving the martensite by heating to produce carbide particles and employing thereof as nuclei, said carburizing being carried out in such a manner that the heating speed of said steel is being controlled under 20° C. per minute in a region from $Ac_1$ temperature to 750° C.-950° C. and the carbon potential in the carburizing atmosphere is being maintained over Acm when the temperature is over $Ac_1$.

2. A method as defined in claim 1 wherein said steel includes less than about 2.4% chromium.

3. A method as defined in claim 1 or 2 wherein the spheroidal or spherical carbides are present more than 30 percent by volume within a region between the case surface and 0.4 mm deep in the case.

* * * * *